US006059038A

United States Patent [19]

Vick, Jr.

[11] Patent Number: 6,059,038

[45] Date of Patent: May 9, 2000

[54] AUTO-FILL SUB

[75] Inventor: James D. Vick, Jr., Dallas, Tex.

[73] Assignee: Halliburton Energy Services, Inc., Dallas, Tex.

[21] Appl. No.: 09/031,564

[22] Filed: Feb. 26, 1998

[51] Int. Cl.[7] ..... E21B 24/10

[52] U.S. Cl. ..... 166/319; 166/323; 166/326; 166/332.1

[58] Field of Search ..... 166/319, 323, 166/326, 332.1, 166, 169; 137/853, 614.2

[56] References Cited

U.S. PATENT DOCUMENTS

| | | | |
|---|---|---|---|
| 3,997,009 | 12/1976 | Fox | 175/107 |
| 4,361,187 | 11/1982 | Luers | 166/326 |
| 5,228,526 | 7/1993 | Vshivkov et al. | 175/317 |
| 5,355,959 | 10/1994 | Walter et al. | 166/321 |
| 5,479,986 | 1/1996 | Gano et al. . | |
| 5,649,597 | 7/1997 | Ringgenberg | 166/373 |

OTHER PUBLICATIONS

Vann Systems Technical Data Sheet for "Vann Circulating Vent (VCV)", undated.

Reference Manual for Well Testing dated 1989.

Halliburton Completion Products 2nd ed., dated 1997, title & back pages and p. 4–21.

*Primary Examiner*—Eileen Dunn Lillis
*Assistant Examiner*—John Kreck
*Attorney, Agent, or Firm*—William M. Imwalle; Marlin R. Smith

[57] ABSTRACT

Apparatus is provided which reliably and conveniently controls fluid flow through a sidewall of a tubular string. In a described embodiment, an auto-fill sub includes a check valve disposed in a housing. The check valve includes a generally tubular flexible member for sealingly engaging a sidewall of the housing to prevent fluid flow through an opening formed through the sidewall. A flow deflector may be provided to prevent abrasive wear, flow cutting and extrusion of the flexible member. Other features may include a lockout sleeve and a piston for displacing the lockout sleeve relative to the housing.

29 Claims, 9 Drawing Sheets

AUTO-FILL SUB

BACKGROUND OF THE INVENTION

The present invention relates generally to equipment utilized in conjunction with wellsite operations and, in an embodiment described herein, more particularly provides an apparatus for automatically filling a tubular string as it is run in a well.

When a tubular string, such as a work string, completion string or production tubing string, etc., is run in a well, it is generally advantageous for fluid in the well to enter the tubular string as it is being lowered into the well. In this manner, fluid pressure in the tubular string may be equalized with that in an annulus formed between the tubular string and the wellbore, subsequent operations which require fluid in the tubular string are made more convenient, etc. It is not always desirable to fill the tubular string with the fluid in the well, but when it is useful to do so, the ability to automatically fill the tubular string as it is run in the well is particularly advantageous.

In order to ensure successful operations, it is generally considered good practice to pressure test the tubular string periodically as it is being run in the well. However, if the tubular string is open-ended, or otherwise open to fluid communication with the annulus, such as via an opening formed through a sidewall of the tubular string, it may be difficult or uneconomical to periodically close off the opening so that a pressure test may be performed, and then reopen the tubular string so that it may continue to fill while it is lowered further in the well. Additionally, when other items of equipment are pressure tested, such as after setting a packer, it may be advantageous to permit fluid flow through the opening in the tubular string. Thus, it may be seen that the ability to open and close the opening in the tubular string at will to permit automatic filling of the tubular string, pressure testing of the tubular string and pressure testing of other equipment in the well, is very beneficial in these operations.

Furthermore, after the tubular string has been installed and pressure testing concluded, or in other situations, it is sometimes advantageous to prevent fluid flow through the tubular string sidewall. For example, after a production tubing string has been installed it may be desirable to close off any opening through the tubing string sidewall, except at particular locations. Thus, an apparatus which permits automatic filling of a tubular string should, in some cases, have the capability of preventing any fluid flow through a sidewall of the apparatus, whether that flow is directed from the annulus to the interior of the tubular string, or from the interior of the tubular string to the annulus.

From the foregoing, it can be seen that it would be quite desirable to provide an apparatus which permits automatic filling of a tubular string as it is run in a well, which permits convenient pressure testing of the tubular string and other equipment in the well, and which may have the capability of preventing fluid flow through a sidewall thereof. It is accordingly an object of the present invention to provide such an apparatus.

SUMMARY OF THE INVENTION

In carrying out the principles of the present invention, in accordance with an embodiment thereof, an apparatus is provided which includes a uniquely configured check valve and optional lockout sleeve. The apparatus permits automatic filling of a tubular string as it is lowered into a well, permits periodic pressure-testing of the tubular string and equipment therein, and if provided with the lockout sleeve, may be operated to prevent fluid flow through a sidewall of a housing of the apparatus.

In one aspect of the present invention, an auto-fill sub is provided which includes a housing having at least one opening formed through a sidewall thereof. A flexible member is positioned relative to the opening so that fluid flow is permitted through the opening in one direction, but prevented in the opposite direction. The flexible member may be generally tubular in shape and may be positioned so that the opening is between opposite ends of the flexible member.

In another aspect of the present invention, a flow deflector may be provided between the opening and the flexible member. The flow deflector may prevent fluid flow through the opening from directly impinging on the flexible member, may prevent extrusion of the flexible member into the opening, and may prevent or retard abrasive wear and flow cutting of the flexible member.

In yet another aspect of the present invention, a lockout sleeve is provided for preventing fluid flow through the housing sidewall. The lockout sleeve may be pressure balanced when it prevents fluid flow through the housing sidewall. Furthermore, a separate piston may be provided for biasing the sleeve in response to fluid pressure applied thereto.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1A:
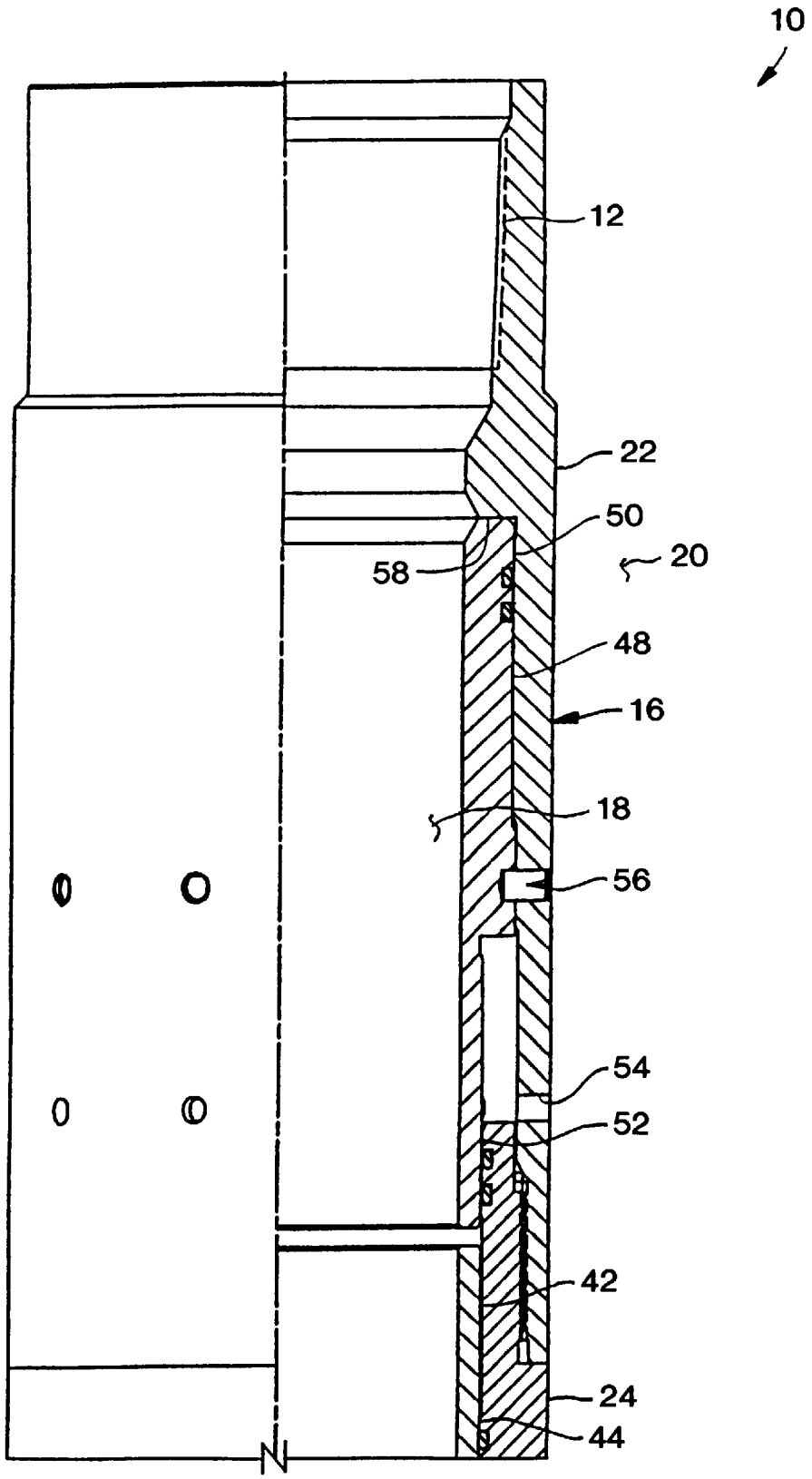
FIGS. 1A&B are quarter-sectional views of a first auto-fill sub embodying principles of the present invention, the auto-fill sub being shown in a configuration in which it is run in a well.

Representatively illustrated in FIGS. 1A&B is an auto-fill sub 10 which embodies principles of the present invention. In the following description of the auto-fill sub 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The auto-fill sub 10 is shown in FIGS. 1A&B in a configuration in which it would typically be interconnected in a tubular string, and run in and installed in a wellbore. It is, of course, well known in the art to interconnect equipment in tubular strings, and the auto-fill sub 10 is provided with threaded portions 12, 14 at either end of a generally tubular housing assembly 16 for threaded and sealing attachment in the tubular string. It will be readily appreciated by a person skilled in the art that, when the auto-fill sub 10 is interconnected in the tubular string and installed in the well, the interior 18 of the auto-fill sub is in fluid communication with the interior of the tubular string and the exterior 20 of the auto-fill sub is in fluid communication with an annulus formed radially between the tubular string and the wellbore of the well.

The housing assembly 16 includes an upper housing 22 coaxially and threadedly attached to a lower housing 24. The housing assembly 16 could, of course, be made up of fewer or greater numbers of individual housings, which could be otherwise attached to each other, without departing from the principles of the present invention.

The lower housing 24 has a circumferentially extending array of openings 26 formed radially through a sidewall 28. Fewer or greater numbers, and smaller or larger dimensions, of the openings 26 may be provided, and the openings may be otherwise oriented and positioned, without departing from the principles of the present invention. Preferably, there is a large number of small openings 26 formed through the sidewall 28, for reasons that will become apparent upon consideration of the further description of the auto-fill sub 10 and its operation below.

A generally tubular flexible closure member 30 is positioned in the lower housing 24 radially inward relative to the openings 26. The closure member 30 is preferably made of an elastomeric material. However, it is to be clearly understood that the closure member 30 could be made of other materials, and other types of materials, without departing from the principles of the present invention. For example, the closure member 30 could be made of a nonelastomeric material, an inflexible material, flexible plastic, etc.

The closure member 30 is positioned closely adjacent the sidewall 28, with the openings 26 axially between opposite ends of the closure member. In this manner, the closure member 30 can block the openings 26 and sealingly engage the sidewall 28 when fluid pressure in the interior 18 is greater than fluid pressure on the exterior 20 of the auto-fill sub 10, and the closure member 30 can radially inwardly displace away from the sidewall, thereby permitting fluid flow through the openings 26, when fluid pressure on the exterior is greater than fluid pressure in the interior of the auto-fill sub.

Figure 1B:
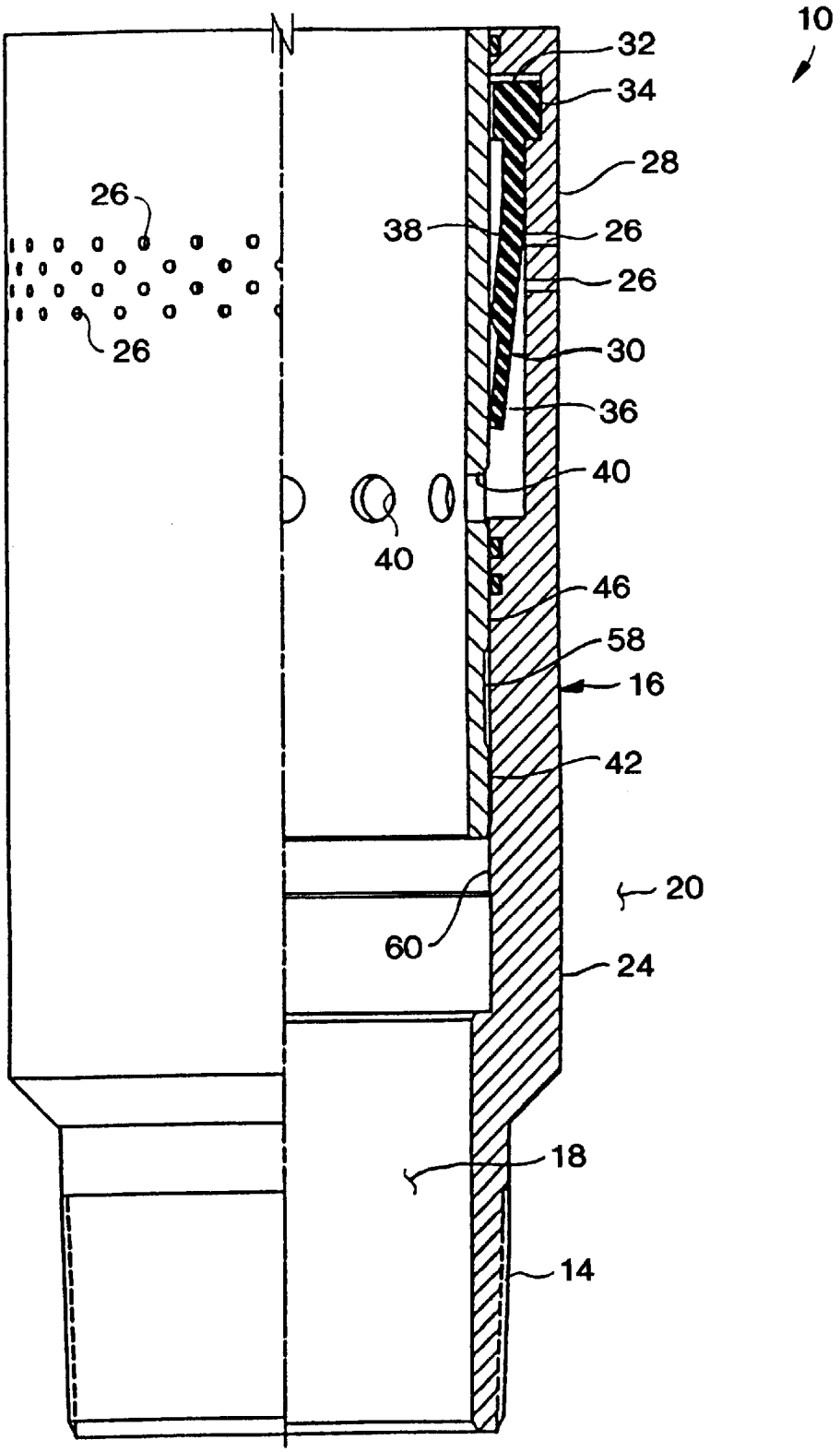

Thus, when the tubular string is being lowered into the well containing fluid in its wellbore, an increase in hydrostatic pressure in the annulus between the tubular string and the wellbore will cause the closure member 30 to sealingly disengage from the sidewall 28 and permit the fluid to flow into the interior 18 of the auto-fill sub 10, thereby automatically filling the tubular string as it is lowered into the well. As shown in FIG. 1B, the closure member 30 is radially inwardly displaced at its lower end and fluid may flow inward through the openings 26 from the exterior 20 to the interior 18 of the auto-fill sub 10.

The closure member 30 is axially retained within the lower housing 24 due to engagement of a radially enlarged upper end 32 being received in an annular recess 34 formed in the lower housing. A lower end 36 of the closure member 30 has a radially reduced cross-section, making it somewhat more flexible for ease in permitting inwardly directed fluid flow through the openings 26. A middle portion 38 is positioned radially opposite the openings 26 and is utilized to block the openings and sealingly engage the sidewall 28, although the ends 34, 36 may also sealingly engage the sidewall. The closure member 30 could be otherwise configured and positioned without departing from the principles of the present invention.

It will now be appreciated that, by providing a large number of the small openings 26, fluid flow directed inwardly through the openings is distributed across a large surface area of the middle portion 38, thereby reducing the effects of flow cutting on the closure member 30. The large number of openings 26 also acts to reduce the velocity of flow through each opening, thereby reducing the effects of abrasive wear on the middle portion 38. Furthermore, the small diameter of each of the openings 26 is more easily sealed by the middle portion 38, and reduces extrusion of the middle portion outward through the openings.

It is to be clearly understood that the illustrated configuration of the closure member 30 and sidewall 28 of the lower housing 24 is not necessary in an apparatus embodying principles of the present invention. For example, it is not necessary for the closure member 30 to be tubular, or for the openings 26 to be circumferentially distributed in the sidewall 28. The openings 26 could be axially distributed, the closure member 30 could have a generally linear or planar shape, the openings could be inclined through the sidewall 28, etc. These and other configurations could be utilized without departing from the principles of the present invention.

After fluid flows inward through the openings 26 and downward between the closure member 30 and the sidewall 28, it passes inward through a series of circumferentially distributed ports 40 formed through a sleeve 42 axially reciprocably received in the lower housing 24, and then into the interior 18 of the auto-fill sub 10. The sleeve 42 is shown in FIGS. 1A&B in a position in which such fluid flow is permitted through the ports 40. However, as will be described more fully below, the sleeve 42 may be shifted to another position in which fluid flow through the ports 40 is prevented.

Therefore, it may be seen that, configured as shown in FIGS. 1A&B, fluid flow is permitted through the sidewall 28 when pressure on the exterior 20 is greater than pressure in the interior 18, but such fluid flow is prevented by the closure member 30 when pressure in the interior is greater than pressure on the exterior (the closure member thus acting as a check valve), and that fluid flow between the interior and exterior may be selectively prevented or permitted through the sidewall regardless of the fluid pressures, depending upon the position of the sleeve 42. At this point, note that the sleeve 42 is pressure-balanced, that is, fluid pressure acting on the sleeve does not bias it to displace in any direction. Instead, it is sealingly engaged at diameters 44, 46 within the lower housing 24, with the diameters being equal.

To displace the sleeve 42, a separate piston 48 is provided. The piston 48 is axially reciprocably and sealingly received in the upper housing 22 at diameters 50, 52, the diameters being unequal and thereby forming a differential piston area therebetween. An aperture 54 formed radially through the upper housing 22 permits fluid pressure on the exterior 20 to act on the piston 48. When fluid pressure on the exterior 20 is greater than fluid pressure in the interior 18, the piston is biased upwardly. Upward displacement of the piston 48 is prevented by a shoulder 58 formed internally on the upper housing 22.

When fluid pressure in the interior 18 is greater than fluid pressure on the exterior 20, the piston 48 is biased downwardly, but displacement of the piston due to this pressure differential is initially prevented by one or more shear pins 56. When the pressure differential reaches a predetermined amount, however, the shear pins 56 will shear and permit the piston 48 to downwardly displace relative to the housing assembly 16, axially contact the sleeve 42 and shift the sleeve downwardly.

Once shifted downwardly by the piston 48, the sleeve 42 remains downwardly shifted regardless of the fluid pressures in the interior 18 and on the exterior 20 of the auto-fill sub 10. This is due to several features of the auto-fill sub 10. The sleeve 42 is pressure-balanced and, thus, is not biased upwardly or downwardly by fluid pressures acting on it. The sleeve 42 is separate from the piston 48 and, thus, although the piston may be upwardly displaced by fluid pressure on the exterior 20 greater than fluid pressure in the interior 18, upward displacement of the piston does not affect the position of the sleeve.

Additionally, the sleeve 42 and lower housing 24 include a locking feature due to an annular recess 58 formed on the sleeve and a radially reduced portion 60 formed internally on the lower housing. When the sleeve 42 is downwardly shifted by the piston 48, the portion 60 cooperatively engages the recess 58, thereby restricting further displacement of the sleeve relative to the lower housing 24. Thus, equipment subsequently passing through the interior 18, slight machining differences in the diameters 44, 46, etc. will not act to displace the sleeve 42 from its downwardly shifted position.

Of course, the sleeve 42, or its lockout function, could be otherwise configured and implemented without departing from the principles of the present invention, and it is not necessary in an auto-fill sub constructed in accordance with the principles of the present invention to include a lockout feature at all. For example, the sleeve 42 could be rotated within the housing assembly 16, instead of being axially displaced, the sleeve 42 could be shifted by a conventional shifting or latching tool engaged with a shifting profile internally formed on the sleeve, the piston 48 could be releasably attached to the sleeve or integrally formed therewith, etc. These and other modifications could be made in an auto-fill sub constructed in accordance with the principles of the present invention.

Figure 2A:
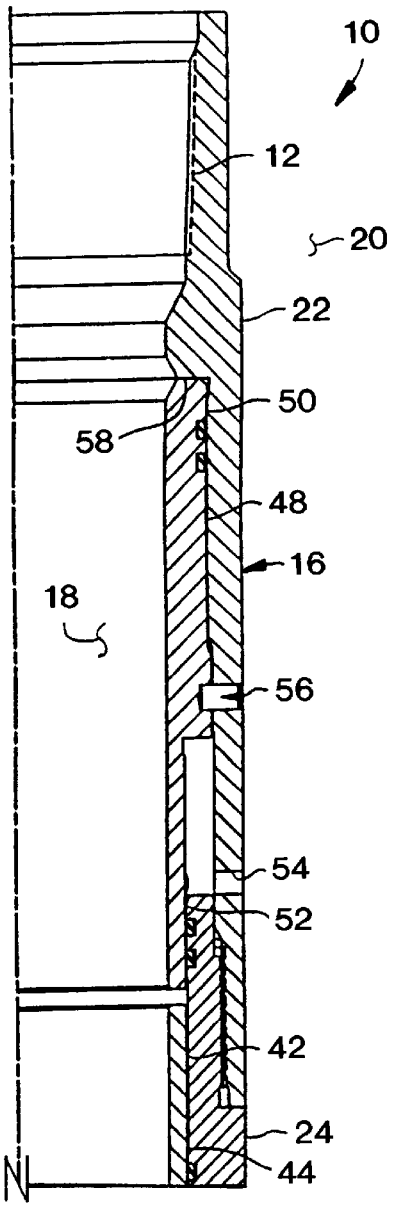
FIGS. 2A&B are quarter-sectional views of the first auto-fill sub in a configuration in which it is used in testing equipment within the well.
Figure 2B:
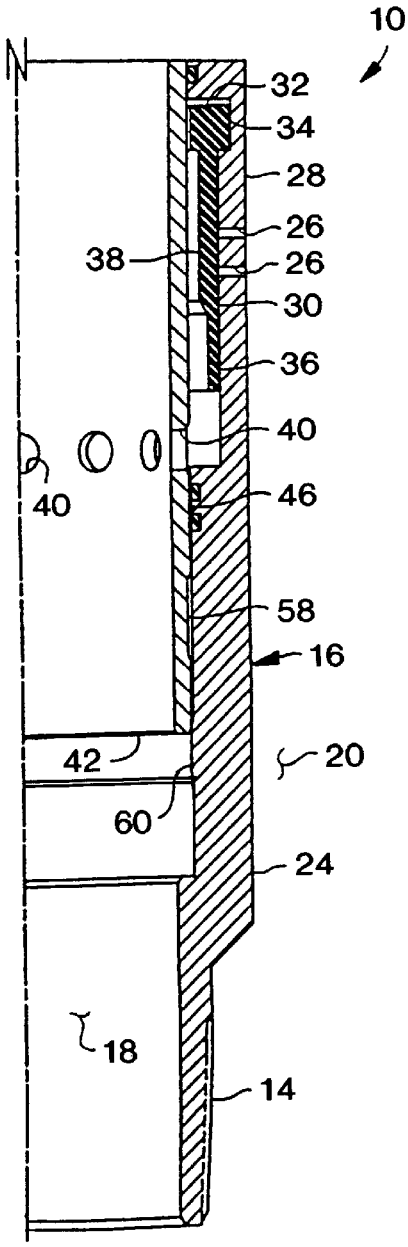

Referring additionally now to FIGS. 2A&B, the auto-fill sub 10 is representatively shown in a configuration in which it may be used in periodic pressure testing of the tubular string in which the auto-fill sub is interconnected. Note that the closure member 30 is against the interior surface of the sidewall 28, thereby preventing fluid flow outward through the openings 26. Thus, when fluid pressure in the interior 18 exceeds fluid pressure on the exterior 20, the closure member 30 sealingly engages the sidewall 28, with the middle portion 38 blocking and preventing fluid flow outward through the openings 26.

Of course, other types of pressure testing may be accomplished with the auto-fill sub 10. For example, if the tubular string includes a packer, the packer may be tested after it is set in the wellbore by applying fluid pressure to the annulus at the earth's surface. With the packer not completely sealingly engaged in the wellbore, fluid pressure will be transmitted to the annulus below the packer and, thus, to the exterior 20 of the auto-fill sub 10. If the fluid pressure in the annulus exceeds the fluid pressure in the interior 18 of the auto-fill sub 10, the closure member 30 will radially inwardly displace and permit fluid flow through the openings 26. This can be detected at the earth's surface as fluid flowing upwardly out of the tubular string.

Figure 3A:
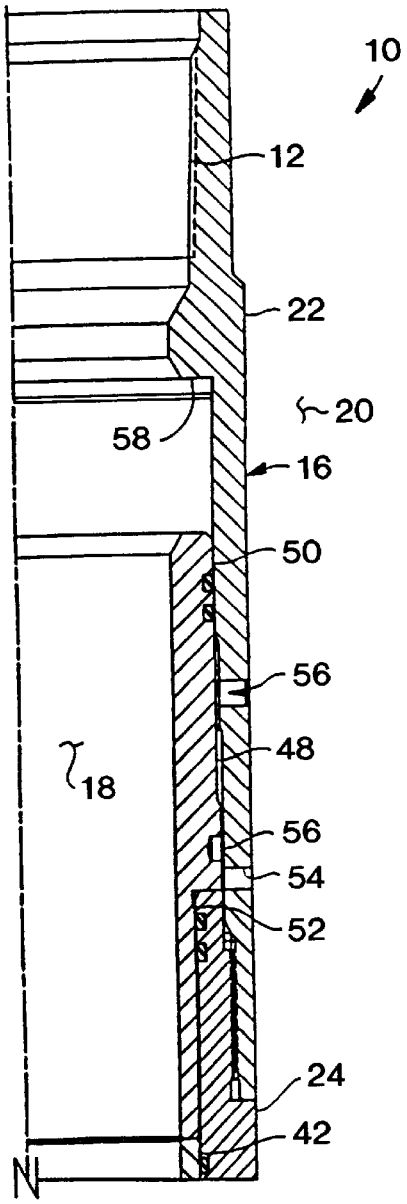
FIGS. 3A&B are quarter-sectional views of the first auto-fill sub in a configuration in which fluid flow through a sidewall portion thereof is prevented.
Figure 3B:
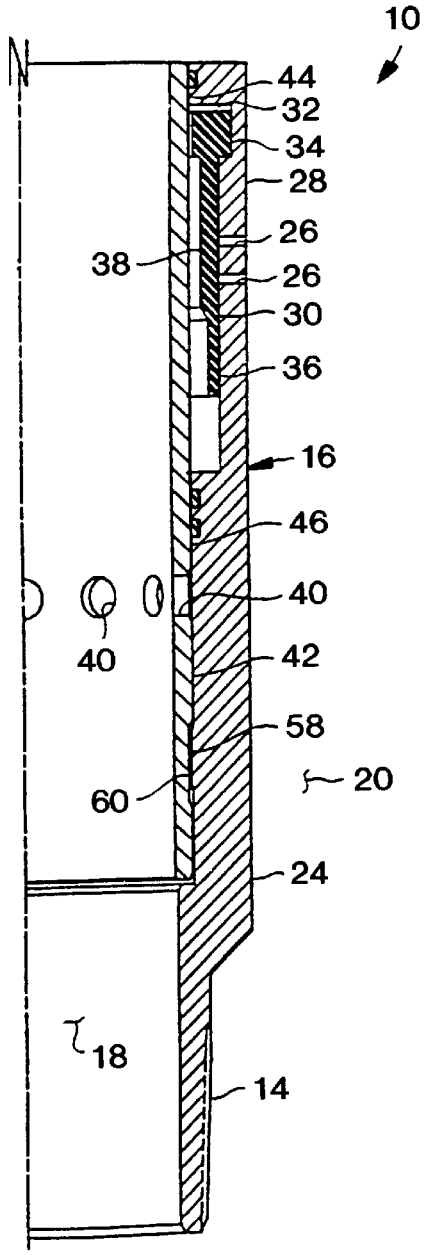

Referring additionally now to FIGS. 3A&B, the auto-fill sub 10 is representatively illustrated in a configuration in which the piston 48 has been downwardly displaced, thereby downwardly shifting the sleeve 42. To accomplish this, fluid pressure has been applied to the interior of the tubular string, so that it exceeds fluid pressure in the annulus by a predetermined amount. This fluid pressure differential has caused the shear pins 56 to shear, and has caused the piston 48 to downwardly displace relative to the housing assembly 16.

The sleeve 42 now prevents fluid flow through the sidewall 28 by preventing fluid communication between the openings 26 and the interior 18. Again, subsequent fluid pressures applied to the interior 18 and exterior 20 of the auto-fill sub 10 will not cause the sleeve 42 to displace from this position. Additionally, cooperative engagement of the portion 60 and recess 58 prevents inadvertent displacement of the sleeve 42 relative to the housing assembly 16.

Figure 4A:
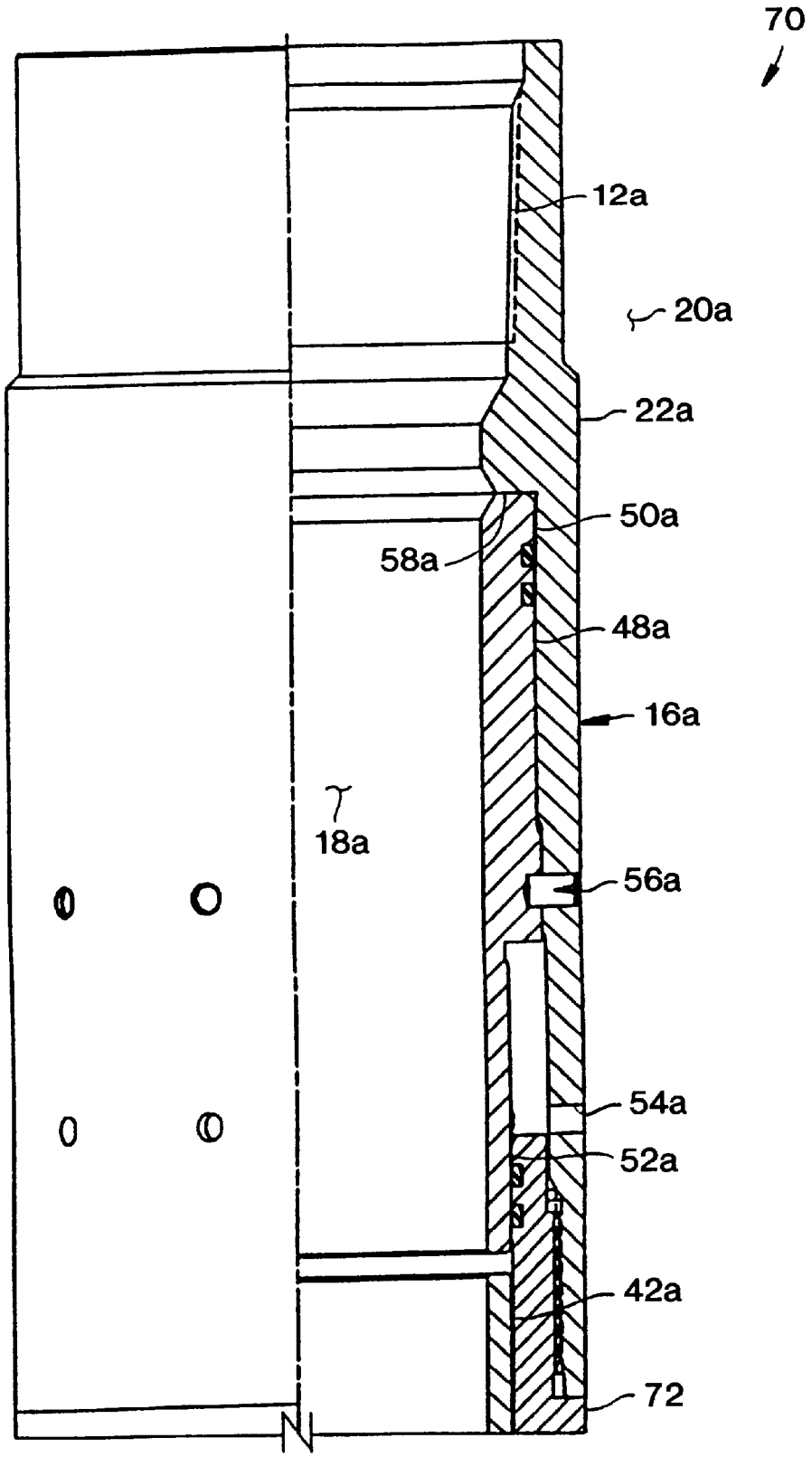
FIGS. 4A&B are quarter-sectional views of a second auto-fill sub embodying principles of the present invention, the auto-fill sub being shown in a configuration in which it is run in a well.
Figure 4B:
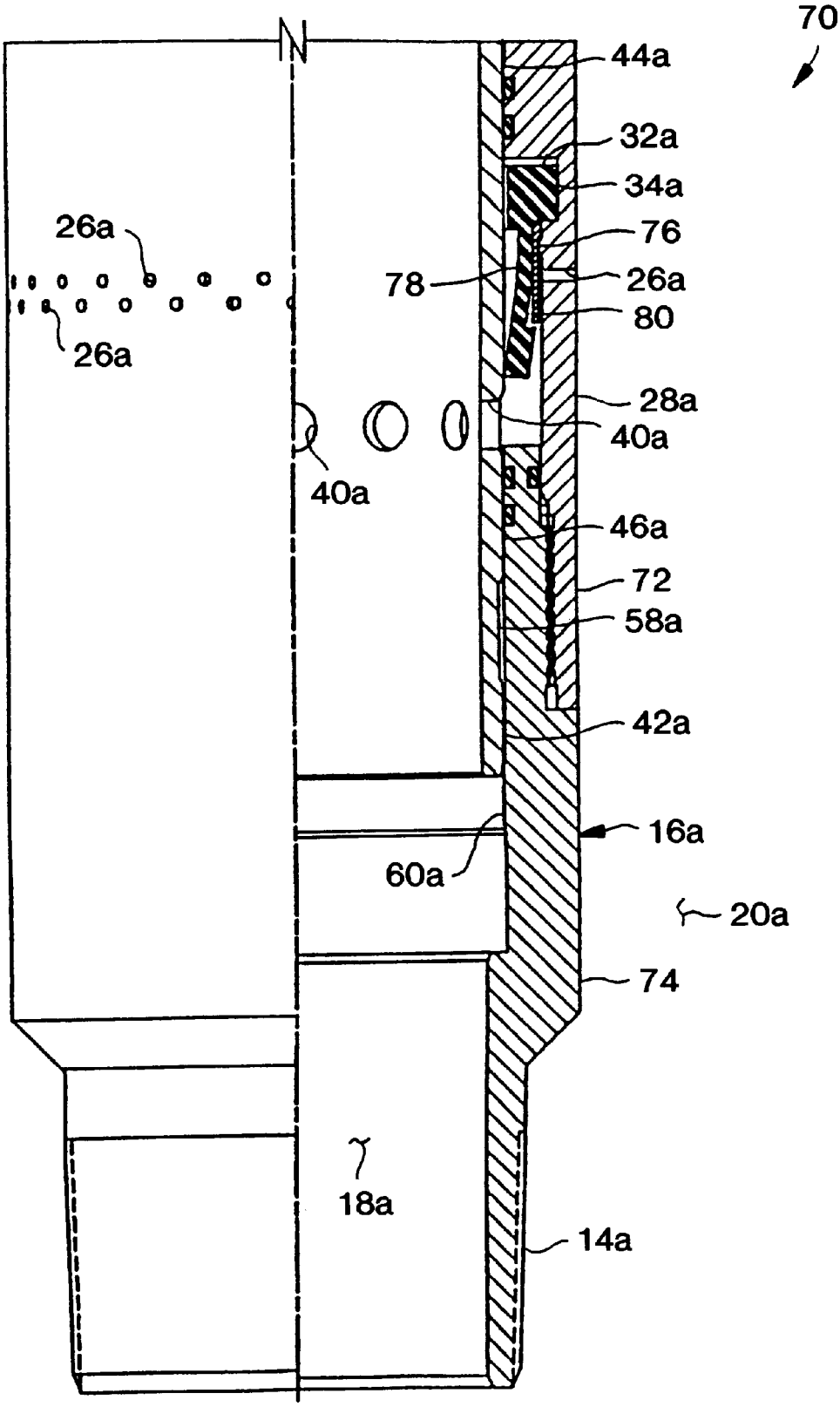
Figure 5A:
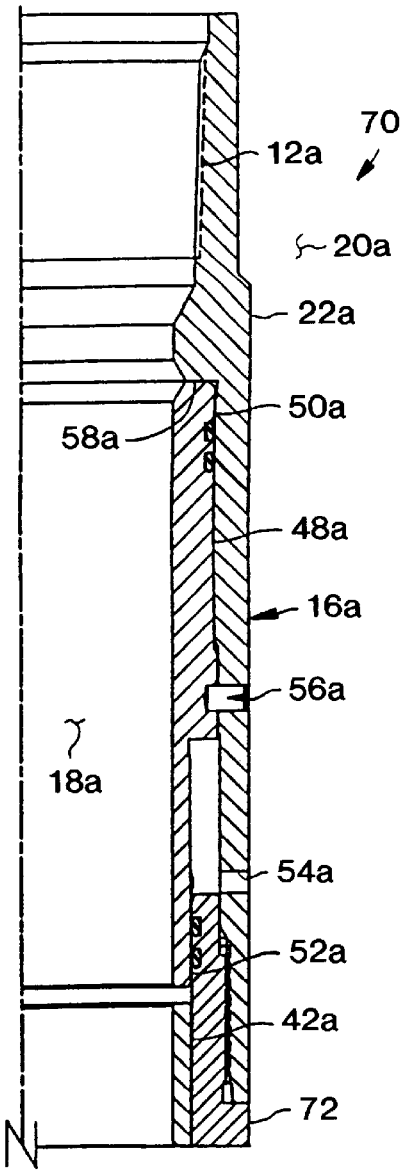
FIGS. 5A&B are quarter-sectional views of the second auto-fill sub in a configuration in which it is used in testing equipment within the well.
Figure 5B:
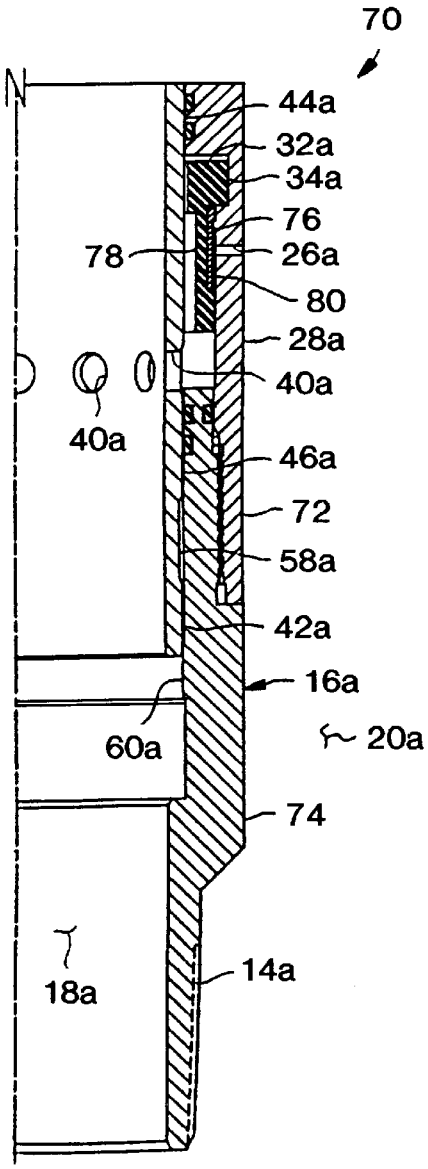

Referring additionally now to FIGS. 4A&B and 5A&B, an alternate construction of an auto-fill sub 70 embodying principles of the present invention is representatively illustrated. Elements of the auto-fill sub 70 which are similar to those previously described are indicated in FIGS. 4A&B and 5A&B with the same reference numbers, with an added suffix "a". In FIGS. 4A&B the auto-fill sub 70 is shown in a configuration in which fluid flows inward through the openings 26*a*, and in FIGS. 5A&B the auto-fill sub is shown in a configuration in which fluid flow through the openings is blocked.

The auto-fill sub 70 is similar in many respects to the auto-fill sub 10 described above. One difference is in the housing assembly 16*a*, which includes a generally tubular intermediate housing 72 threadedly and sealingly attached to a generally tubular lower housing 74. However, it will be readily appreciated that the combined intermediate and lower housings 72, 74 are similar to the lower housing 24 of the auto-fill sub 10. By providing for detachment of the intermediate and lower housings 72, 74, a generally tubular flow deflector 76 and flexible closure member 78 may be conveniently installed opposite the sidewall 28*a* in the intermediate housing before it is attached to the lower housing.

The flow deflector 76 is positioned radially opposite the openings 26*a* and is, thus, positioned radially between the openings and the closure member 78. The flow deflector 78 is also radially spaced apart from the sidewall 28*a* in the area opposite the openings 26*a*, so that inwardly directed fluid flow is permitted through the openings, but is engaged with the sidewall above the openings. The flow deflector 76 is positioned in an annular recess 80 formed externally on the closure member 78, so that the closure member may sealingly engage the sidewall 28*a* above and below the flow deflector to prevent outwardly directed fluid flow through the openings 26*a*.

It will be readily appreciated that, when fluid flows inwardly through the openings 26*a*, it will impinge directly on the flow deflector 76 instead of on the closure member 78. This reduces or eliminates flow cutting and abrasive wear of the closure member 78. Additionally, since the closure member 78 sealingly engages the sidewall 28*a* above and below the openings 26*a*, but is maintained radially spaced apart from the openings by the flow deflector 76, extrusion of the closure member into the openings is eliminated.

As with the auto-fill sub 10 described above, the sleeve 42*a* of the auto-fill sub 70 may be shifted downwardly by applying a predetermined fluid pressure differential from the interior 18*a* to the exterior 20*a*.

Figure 6A:
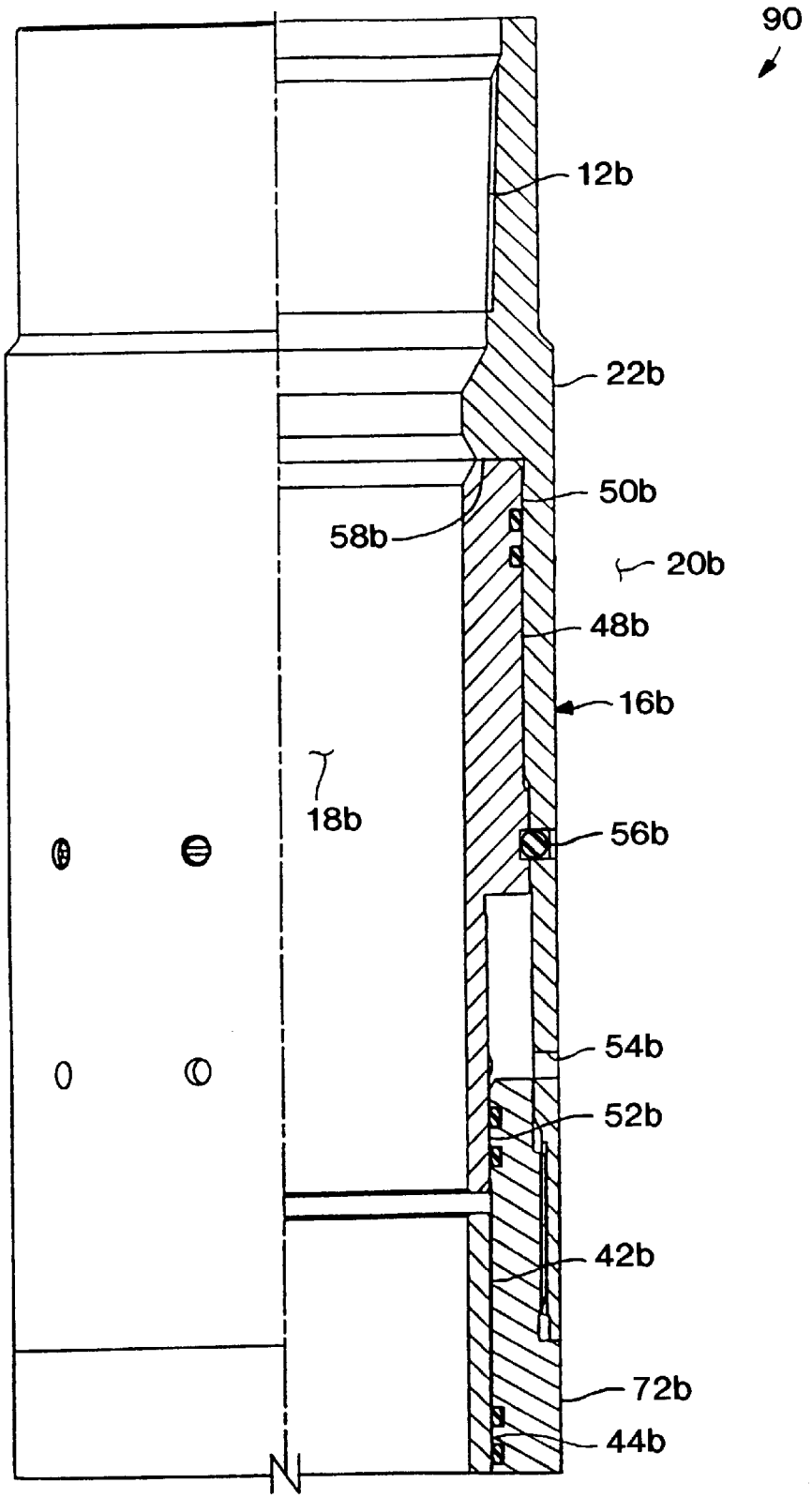
FIGS. 6A&B are quarter-sectional views of a third auto-fill sub embodying principles of the present invention, the auto-fill sub being shown in a configuration in which it is run in a well.
Figure 6B:
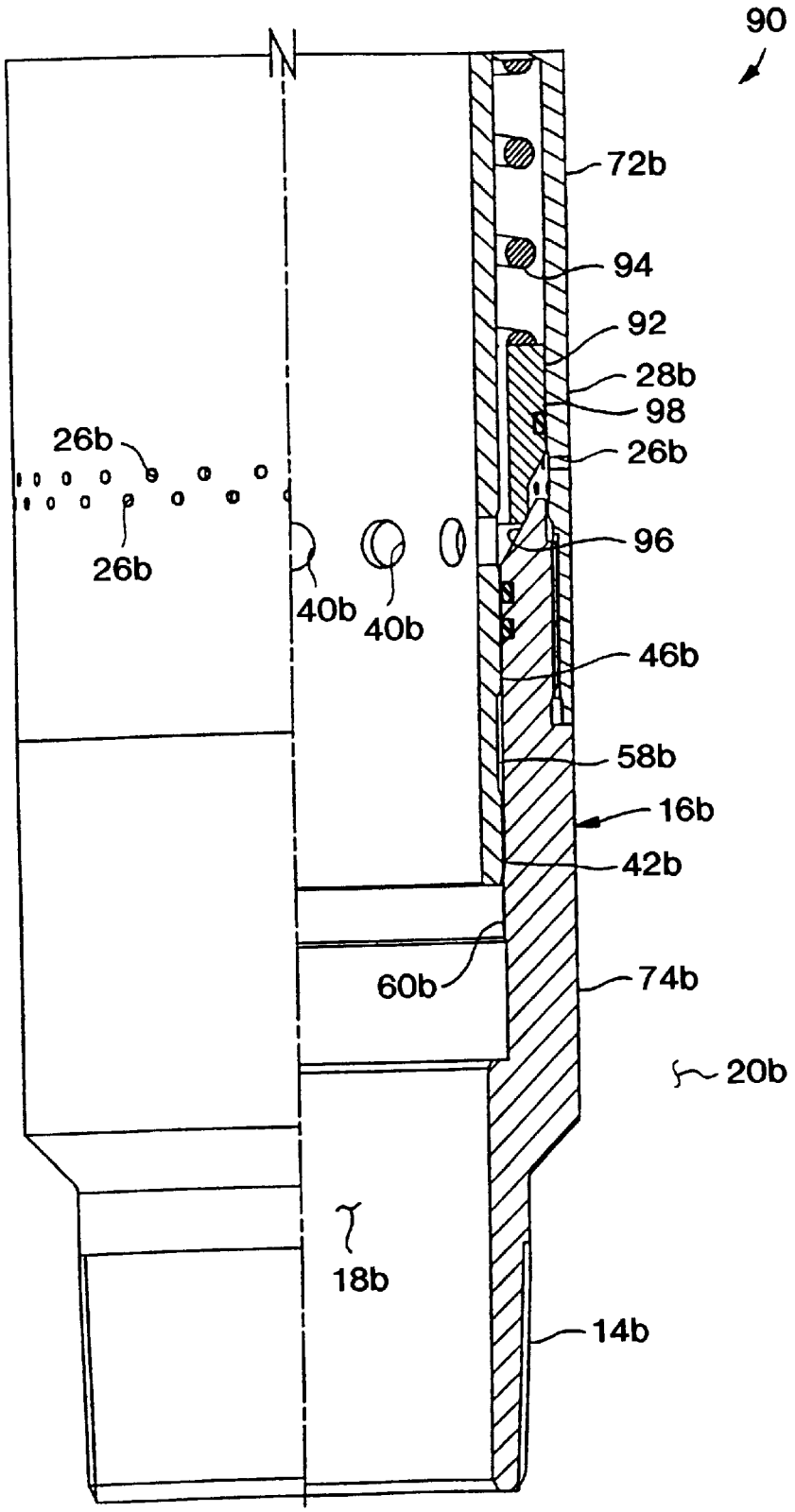

Referring additionally now to FIGS. 6A&B, another auto-fill sub 90 is representatively illustrated. Elements of the auto-fill sub 90 which are similar to those previously described are indicated in FIGS. 6A&B using the same reference numbers, with an added suffix "b". As shown in FIGS. 6A&B, the auto-fill sub 90 is in a configuration in which fluid flow through the openings 26*b* is blocked.

The auto-fill sub 90 illustrates that principles of the present invention may be incorporated in an apparatus that does not include a flexible closure member. Instead of the flexible closure member, the auto-fill sub 90 includes a conventional check valve configuration including a generally annular-shaped poppet 92 sealingly and axially reciprocably received within the intermediate housing 72*b*, and a biasing member or spring 94. The spring 94 biases the poppet 92 to engage an annular seal surface 96 formed on an upper end of the lower housing 74*b*.

Note that the poppet 92 sealingly engages the intermediate housing 72*b* at a diameter 98 greater than that at which it sealingly engages the seal surface 96, thereby forming a differential piston area therebetween. Thus, when fluid pressure in the interior 18*b* exceeds fluid pressure on the exterior 20*b*, the poppet 92 is biased toward sealing engagement with the seal surface 96 by the spring 94 and by the differential fluid pressure acting on the differential piston area, and is sealingly engaged with the housing assembly 16*b* above and below the openings 26*b*. When fluid pressure on the exterior 20*b* exceeds fluid pressure in the interior 18*b* by an amount sufficient to overcome the biasing force of the spring 94, the poppet 92 will sealingly disengage from the seal surface 96, and fluid flow will be permitted through the openings 26*b*.

As with the auto-fill subs 10 and 70 described above, the sleeve 42*b* of the auto-fill sub 90 may be shifted downwardly by applying a predetermined fluid pressure differential from the interior 18*b* to the exterior 20*b*.

Of course, many modifications, additions, deletions, substitutions and other changes may be made to the representatively illustrated embodiments of the present invention, which changes would be obvious to a person skilled in the art. Accordingly, the foregoing detailed description is to be clearly understood as being given by way of illustration and example only, the spirit and scope of the present invention being limited solely by the appended claims.

What is claimed is:

1. An auto-fill sub, comprising:

a generally tubular housing having at least one opening formed through a sidewall thereof;

a check valve permitting fluid flow through the opening in a first direction and preventing fluid flow through the opening in a second direction, the check valve including a generally tubular flexible member;

a sleeve carried by the housing for movement relative thereto from a first position in which the sleeve permits fluid flow through the check valve to a second position in which the sleeve prevents fluid flow through the check valve; and a piston carried by the housing for movement relative to the sleeve and being operative to displace the sleeve from the first position to the second position.

2. The auto-fill sub according to claim 1, wherein the flexible member has opposite ends, one of the opposite ends being radially secured relative to the housing sidewall, and the other opposite end being radially displaceable relative to the housing sidewall.

3. The auto-fill sub according to claim 2, wherein the opposite ends axially straddle the opening.

4. The auto-fill sub according to claim 1, further comprising a generally tubular flow deflector positioned radially between the opening and the flexible member.

5. The auto-fill sub according to claim 4, wherein the flow deflector is further positioned axially between opposite ends of the flexible member.

6. The auto-fill sub according to claim 1, wherein the flexible member is made of an elastomeric material.

7. The auto-fill sub according to claim 1, wherein the flexible member is made of a nonelastomeric material.

8. The auto-fill sub according to claim 1, wherein, in the second position of the sleeve, the sleeve is sealingly engaged with the housing axially straddling the opening.

9. The auto-fill sub according to claim 1, wherein, in the second position of the sleeve, the sleeve is pressure-balanced.

10. The auto-fill sub according to claim 1, wherein, in the first position of the sleeve, the sleeve is pressure-balanced.

11. The auto-fill sub according to claim 1, wherein, in the second position of the sleeve, the sleeve is sealingly engaged with the housing between first and second diameters.

12. The auto-fill sub according to claim 11, wherein the first and second diameters are equal to each other.

13. The auto-fill sub according to claim 1, wherein in the second position of the sleeve, the sleeve is secured against displacement to the first position.

14. The auto-fill sub according to claim 13, wherein, in the second position of the sleeve, the sleeve is secured by engagement of a radially enlarged portion with a radially reduced portion.

15. The auto-fill sub according to claim 13, wherein, in the second position of the sleeve, the sleeve is secured by engagement of a radially reduced portion formed on the housing with an annular recess formed on the sleeve.

16. The auto-fill sub according to claim 1, wherein the piston is sealingly and reciprocably received relative to the housing.

17. The auto-fill sub according to claim 1, wherein the piston biases the sleeve to displace from the first position to the second position in response to a difference in fluid pressure between the interior of the housing and the exterior of the housing.

18. The auto-fill sub according to claim 17, wherein the piston is releasably secured against displacement relative to the housing.

19. The auto-fill sub according to claim 1, further comprising a shear member releasably securing the piston against displacement relative to the housing.

20. Apparatus operatively positionable within a subterranean well having a tubular string positioned within a wellbore thereof, an annulus being formed between the tubular string and the wellbore, the apparatus comprising:

a housing interconnectable in the tubular string;

a check valve permitting fluid flow from the annulus to the interior of the tubular string, and preventing fluid flow from the interior of the tubular string to the annulus, when interconnected in the tubular string; and a sleeve displaceable from a first position in which fluid flow is permitted through the check valve to a second position in which fluid flow is prevented through the check valve, the sleeve, when in the second position, being pressure-balanced.

21. The apparatus according to claim 20, wherein the check valve includes a generally tubular flexible member sealingly engageable with the housing across at least one opening formed through a sidewall of the housing.

22. The apparatus according to claim 21, further comprising a flow deflector positioned radially between the opening and the flexible member.

23. The apparatus according to claim 20, further comprising a piston, the piston biasing the sleeve from the first position to the second position in response to fluid pressure applied thereto.

24. The apparatus according to claim 23, wherein the piston biases the sleeve in response to fluid pressure in the tubular string greater than fluid pressure in the annulus, when interconnected in the tubular string.

25. Apparatus operatively positionable in a subterranean well, the apparatus comprising:

a generally tubular housing having at least one opening formed through a sidewall thereof;

a generally tubular flexible member having opposite ends, the flexible member being disposed radially inward relative to the housing sidewall with the opening axially between the opposite ends, the flexible member sealingly engaging the housing sidewall and preventing fluid flow through the opening when fluid pressure in the interior of the housing exceeds fluid pressure external to the housing, and at least one of the opposite ends sealingly disengaging the housing sidewall and permitting fluid flow through the opening when fluid pressure external to the housing exceeds fluid pressure in the interior of the housing; and a sleeve selectively displaceable between a first position in which fluid flow is permitted through the opening and a second position in which fluid flow is prevented through the opening, the sleeve, in the second position thereof, being pressure-balanced.

26. The apparatus according to claim 25, wherein the apparatus further comprises a substantially rigid and generally tubular flow deflector disposed radially between the opening and the flexible member.

27. The apparatus according to claim 26, wherein the flow deflector has opposite ends, one of the flow deflector opposite ends being engaged with the housing sidewall, and the other of the flow deflector opposite ends being radially spaced apart from the housing sidewall.

28. Apparatus operatively positionable in a subterranean well, the apparatus comprising:

a generally tubular housing having at least one opening formed through a sidewall thereof;

a generally tubular flexible member having opposite ends, the flexible member being disposed radially inward relative to the housing sidewall with the opening axially between the opposite ends, the flexible member sealingly engaging the housing sidewall and preventing fluid flow through the opening when fluid pressure in the interior of the housing exceeds fluid pressure external to the housing, and at least one of the opposite ends sealingly disengaging the housing sidewall and permitting fluid flow through the opening when fluid pressure external to the housing exceeds fluid pressure in the interior of the housing;

a sleeve selectively displaceable between a first position in which fluid flow is permitted through the opening and a second position in which fluid flow is prevented through the opening; and a piston movable relative to the sleeve and biasing the sleeve from the first position to the second position in response to fluid pressure in the interior of the housing greater than fluid pressure on the exterior of the housing.

29. The apparatus according to claim 28, wherein the piston is releasably secured against displacement relative to the housing, the piston biasing the sleeve from the first position to the second position when fluid pressure in the interior of the housing exceeds fluid pressure on the exterior of the housing by a predetermined amount.

* * * * *